US006766616B2

(12) United States Patent
Richter

(10) Patent No.: US 6,766,616 B2
(45) Date of Patent: Jul. 27, 2004

(54) OPENING FLAP, IN PARTICULAR FLUE GAS ESCAPE FLAP, AND OPENING MECHANISM THEREFOR

(75) Inventor: Stefan Richter, Ahorntal (DE)

(73) Assignee: SUSPA Holding GmbH, Altdorf (DE)

( * ) Notice: Subject to any disclaimer, the term of this patent is extended or adjusted under 35 U.S.C. 154(b) by 0 days.

(21) Appl. No.: 10/648,374

(22) Filed: Aug. 27, 2003

(65) Prior Publication Data

US 2004/0043722 A1 Mar. 4, 2004

(30) Foreign Application Priority Data

Aug. 27, 2002 (DE) ..... 102 40 039

(51) Int. Cl.[7] ..... E05F 11/28
(52) U.S. Cl. ..... 49/345; 049/1; 049/379
(58) Field of Search ..... 49/1, 2, 4, 8, 339, 49/345, 347, 379; 220/264; 454/199, 357, 358

(56) References Cited

FOREIGN PATENT DOCUMENTS

| | | |
|---|---|---|
| DE | 24 11 338 | 9/1975 |
| DE | 76 14 963 | 9/1976 |
| DE | 33 38 092 | 8/1994 |

*Primary Examiner*—Harold Joyce
(74) *Attorney, Agent, or Firm*—Browdy and Neimark, P.L.L.C.

(57) ABSTRACT

An opening flap comprises a frame and a flap articulated thereto. A lift arm is provided, which is articulated by a principal energy accumulator. A secondary energy accumulator is articulated between the lift arm and the flap. The principal energy accumulator delivers the opening motion of the flap into a position before the dead center thereof. The secondary energy accumulator, which is distinctly weaker, delivers the subsequent opening motion.

22 Claims, 9 Drawing Sheets

OPENING FLAP, IN PARTICULAR FLUE GAS ESCAPE FLAP, AND OPENING MECHANISM THEREFOR

BACKGROUND OF THE INVENTION

1. Field of the Invention

The invention relates to an opening flap, in particular flue gas escape flap, comprising a frame; a flap that is articulated to the frame; a holding device for keeping the flap in a closed position; a lift arm which is mounted for pivoting about a first joint that is stationary relative to the frame; a principal energy accumulator, a first end of which is articulated to a second joint that is stationary relative to the frame, and a second end of which is articulated to the lift arm by a third joint at a distance from the first joint; and a secondary energy accumulator, a first end of which is articulated to the lift arm between the first and the second joint, and a second end of which is articulated to the flap. The invention further relates to an opening mechanism for an opening flap according to the invention.

2. Background Art

Flue gas escape flaps are employed predominantly for safety reasons in industrial buildings. They are supposed to be opened for fresh air and, possibly, light to enter; on the other hand, they must open automatically when for instance in the case of a fire or the like. Usually the flaps are held by a rope, by means of which they can also be shut. If the rope is loosened from its holding device at an easily accessible place, the flap will open automatically by means of an opening mechanism. By means of the rope it can be closed against the force of the opening mechanism. The rope is fixed to the flap by means of a holding device, for instance a lock with a safety fuse. This holding device unlocks in the case of fire so that the flap will open automatically. Gas springs are used as opening mechanisms for small flaps; they are articulated to the frame on the one hand and to the flap on the other. In the case of big flaps, it has been found that gas springs are not suitable. This is due to the fact that the opening mechanism must overcome not only the dead weight of the flap, but must be able also to lift comparatively heavy snow loads on the flap and force them aside upon pivoting beyond the proper upper dead center. Therefore, it has become a habit that pneumatically actuated piston-cylinder drives should be used instead of gas springs as opening mechanisms for big flaps; for opening, supply takes place from a pressure gas source, for instance a $CO_2$ pressure cylinder.

DE 33 38 092 C3 describes a flap of the generic type, in which the additional energy accumulator is directly articulated to the lift arm, which results in extraordinarily bulky design. Moreover, the directions of application of force are rather unfavorable, opening heavy flaps being hardly, or not at all, possible.

SUMMARY OF THE INVENTION

It is an object of the invention to embody an opening flap of the generic type in such a way that big and heavy flaps can be opened by simple means.

According to the invention, this object is attained by the features which consist in that a double-armed lever is articulated to the lift arm by a pivot joint, to a first end, turned towards the principal energy accumulator, of which lever the secondary energy accumulator is articulated by its first end, and to a second end, turned towards the flap, of which lever is articulated a first end of a tie which is articulated by a second end relative to the frame. The measures according to the invention help attain that, at the beginning of the opening process when maximum load must be overcome, the principal gas spring exclusively or at least predominantly does the opening job, the secondary gas spring only serving as a forcing lever, transmitting the opening forces from the lift arm to the flap. The principal gas spring is completely extended only when the flap has been opened sufficiently far for a load of snow that might lie on it to have slipped off and any wind power has been overcome. Then the secondary gas spring takes the job of completely opening the flap as far as by an angle of approximately 140° as against the closed position of the flap. This design is appropriate in particular for heavy flaps to be lifted. In keeping with the improved opening mechanism according to which the double-armed lever and the tie are arranged and designed such that, at the beginning of the opening motion of the flap, the first end of the secondary energy accumulator is moved counter to a direction of extension of the secondary energy accumulator, pivoting the double-armed lever, and according to which the pivoting motion of the double-armed lever reverses as the opening motion of the flap proceeds, provision is made for a type of transmission by means of which to accomplish a certain reducing effect at the beginning of the opening motion when major opening forces are needed and a certain multiplication as the opening motion proceeds and the required forces decrease.

The advantageous embodiment, according to which a stop is provided on the lift arm within the pivoting travel of the double-armed lever, ensures that the length of extension of the principal gas spring is restricted and the opening mechanism in the way of a transmission cannot tip over.

The further development, according to which $F_{12} \geqq F_{16}$, and in particular $6\ F_{16} \geqq F_{12} \geqq 2\ F_{16}$, and especially $10\ F_{16} \geqq F_{12} \geqq 2\ F_{16}$, applies to the extension force $F_{12}$ of the principal energy accumulator in relation to the extension force $F_{16}$ of the secondary energy accumulator, has regularly proved to be of advantage, favorably aiding in the specified repartition of forces.

With gravity acting on the flap in the final stage of the opening motion, the embodiment, according to which the secondary energy accumulator is a gas spring that is damped in the direction of extension, is as a rule of special advantage.

Furthermore, an opening mechanism is protected, including the features according to the invention.

Further features, advantages and details of the invention will become apparent from the ensuing description of two exemplary embodiments, taken in conjunction with the drawing.

DESCRIPTION OF PREFERRED EMBODIMENTS

Figure 5:
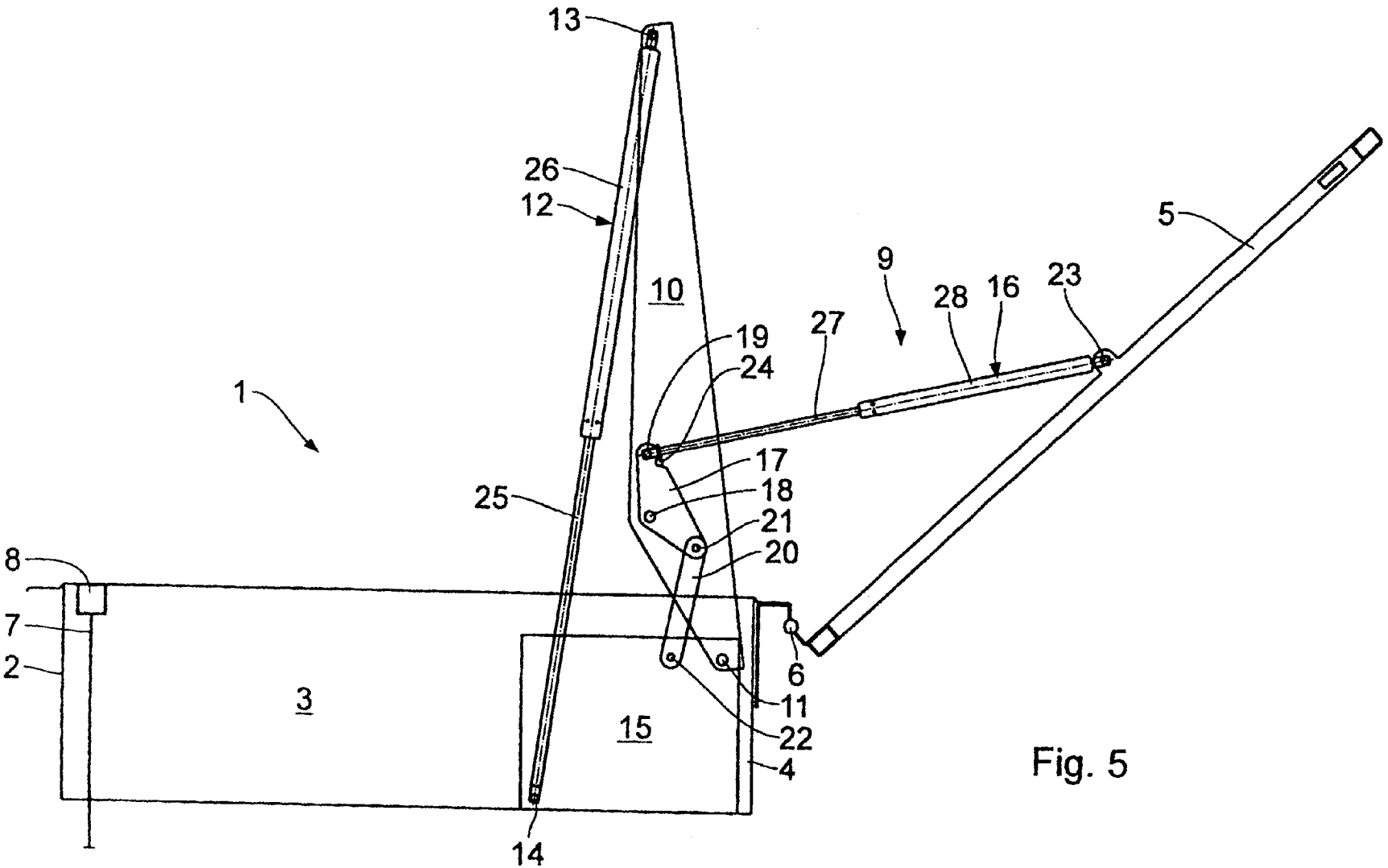

The roof-top skylight seen in the drawing works as a so-called flue gas escape flap mainly used in roofs of workshop halls. It has a frame 1 (roughly outlined) in the shape of a cuboid, which is open to the bottom and to the top, having a front wall 2, two side walls—only one side wall 3 of which is shown—and a rear wall 4. The flap 5, which may be designed as a window, is articulated to the upper edge of the rear wall 4 by means of a hinge 6 for it to pivot from a position of rest on the frame 1 into a position of opening by distinctly more than 90°, for example by approximately 140°, as seen in FIG. 5. The flap 5 is kept in the closed position by a rope 7 (roughly outlined), the holding device 8, by means of which the rope 7 is fixed to the flap in the vicinity of the front wall 2 of the frame 1, including a conventional safety fuse or the like which, in the case of fire, automatically disengages the rope 7 and the flap 5. Holding devices 8 and safety fuses of this type are general practice.

For opening the flap 5, be it by loosening the rope 7 or by the mentioned release of the holding device 8, provision is made for an opening mechanism 9 which is disposed in the vicinity of the side wall 3. Of course, such a mechanism 9 may be allotted to each side wall 3 for reasons of symmetry, in particular in the case of heavy flaps 5. It is of course also conceivable to allocate several of these opening mechanisms 9 to the rear wall 4.

The mechanism 9 comprises a lift arm 10 which is articulated by a pivot joint 11 in vicinity to the rear wall 4. The lift arm 10 reaches over a substantial part of the length of the side wall 3. A principal gas spring 12 in the form of a compressed gas spring, as a principal energy accumulator, is articulated to the end of the lift arm 10 that is contiguous to the front wall 2. Below the lift arm 10, the other end of the gas spring 12 is articulated, by another pivot joint 14, to a base plate 15 that is mounted on the rear wall 4. The principal gas spring 12 is equally articulated to the base plate 15.

A secondary gas spring 16 is provided as a secondary energy accumulator; it is linked to the lift arm 10 via a double-armed lever 17, which is articulated to the lift arm 10 by a pivot joint 18 that is provided in the middle of the lever 17. By means of a pivot joint 19, the secondary gas spring 16 is articulated to such an end of the lever 17 that is the bottom end when the flap 5 is shut. A tie 20, in the form of a tie rod or traction rope, acts via a joint 21 on the opposite end of the lever 17. The tie 20 is mounted by a joint 22 on the base plate 15. The end, opposite the pivot joint 19, of the secondary gas spring 16 is articulated to the flap 5 by a pivot joint 23. A stationary stop 24 is provided on the lift arm 10, which the double-armed lever 24 bears against in vicinity to the joint 19 shortly before the principal gas spring 12 is entirely extended. For clarification it must be mentioned that the secondary gas spring 16, the double-armed lever 17 and the tie 20 are located between the base plate 15 and the lift arm 10. These parts are plotted in solid lines also in the vicinity of the lift arm 10 only for improved illustration.

The extension force $F_{12}$ of the principal gas spring 12 clearly exceeds the extension force $F_{16}$ of the secondary gas spring 16. $F_{12}>F_{16}$ applies, in particular $6\ F_{16} \geqq F_{12} \geqq 2\ F_{16}$, and especially $10\ F_{16} \geqq F_{12} > 2\ F_{16}$. Specific dimensioning depends on the precise arrangement of the gas springs 12, 16, on the length and kind of articulation of the lift arm 10, the weight of the flap 5 and on further variables.

Figure 4:
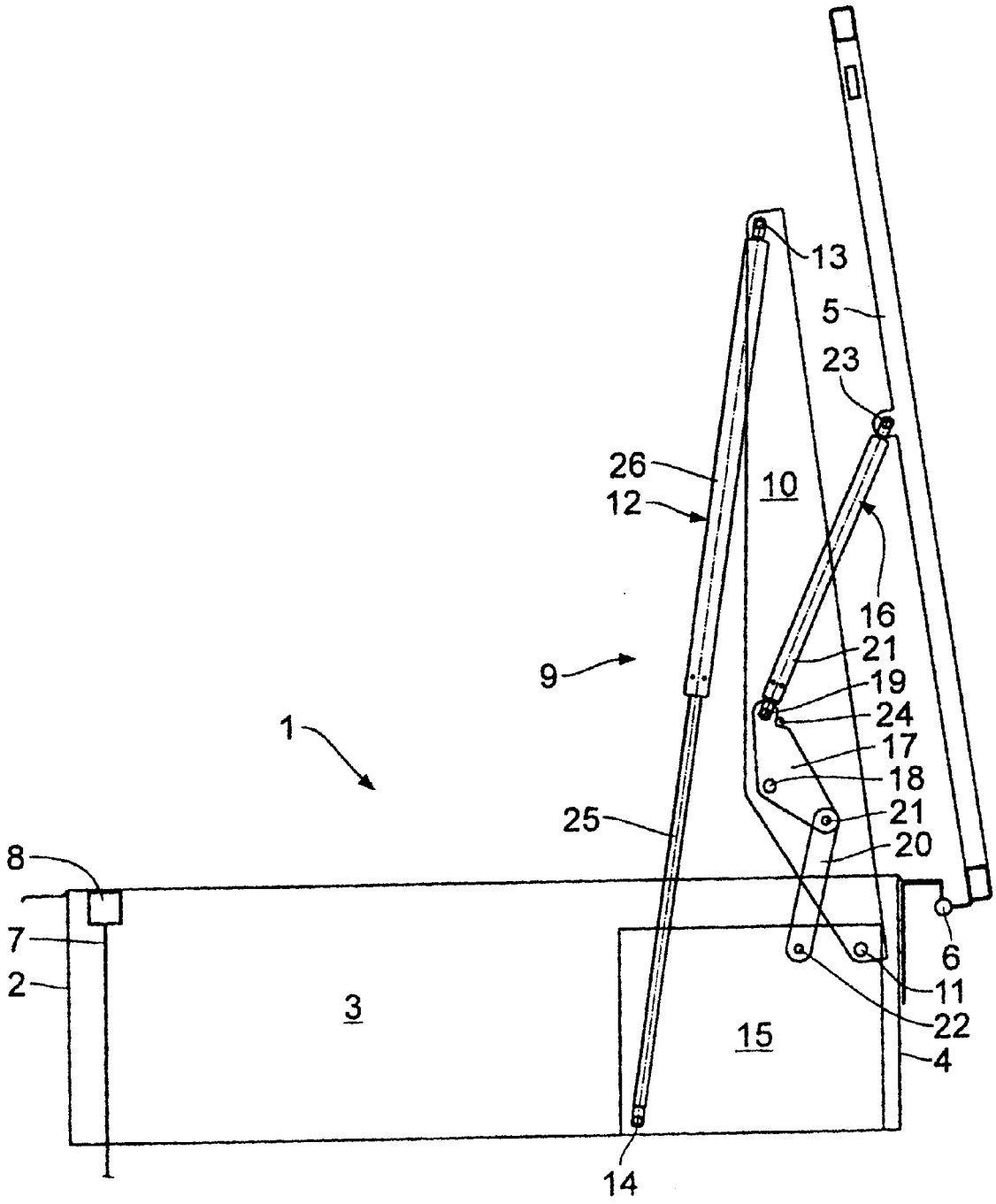

The mode of operation will become apparent from FIGS. 1 to 5:

When—as mentioned above—the rope 7 is loosened, the flap 5 is opened by the opening mechanism 9. At first, only the piston rod 25 of the principal gas spring 12 is extended from the casing 26, moving the lift arm 10 from a position approximately parallel to the side wall 3 into a position that is approximately perpendicular thereto. While the flap 5 is pivoted upwards from the closed position of FIG. 1 by 80° to 90° into an upright position approximately perpendicular to the frame 1, as seen in FIG. 4, then the secondary gas spring 16 only acts as a transmission rod i.e., as a forcing lever. The principal gas spring 12 is then completely extended.

Figure 1:
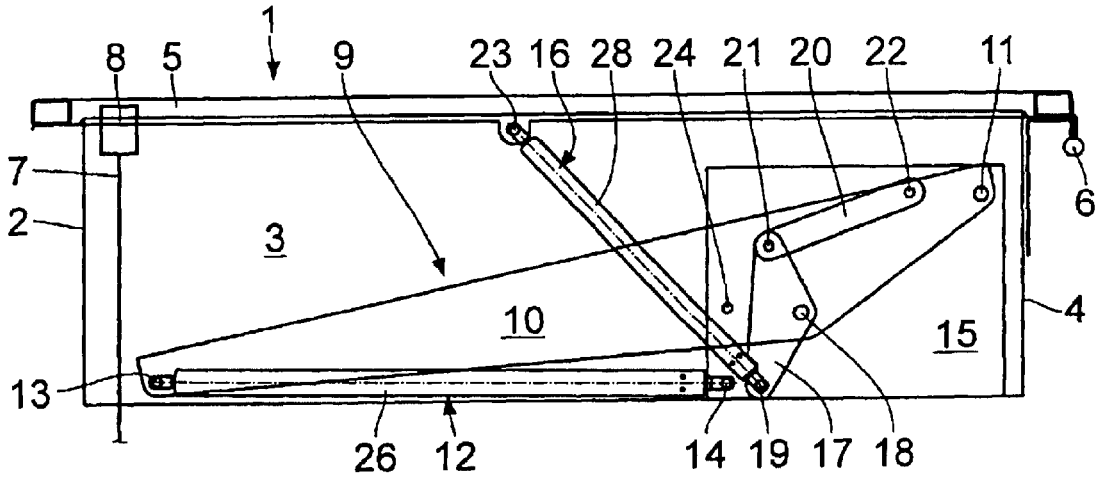
FIGS. 1 to 5 are illustrations of a first exemplary embodiment of a flue gas escape flap in varying positions ranging from a closed to an entirely open position.
Figure 2:
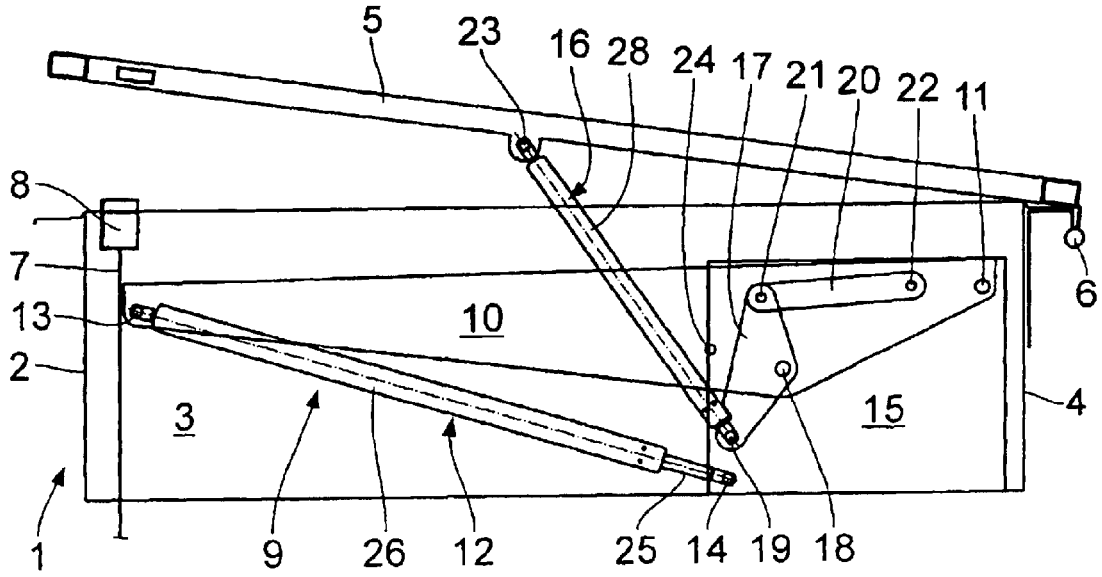
Figure 3:
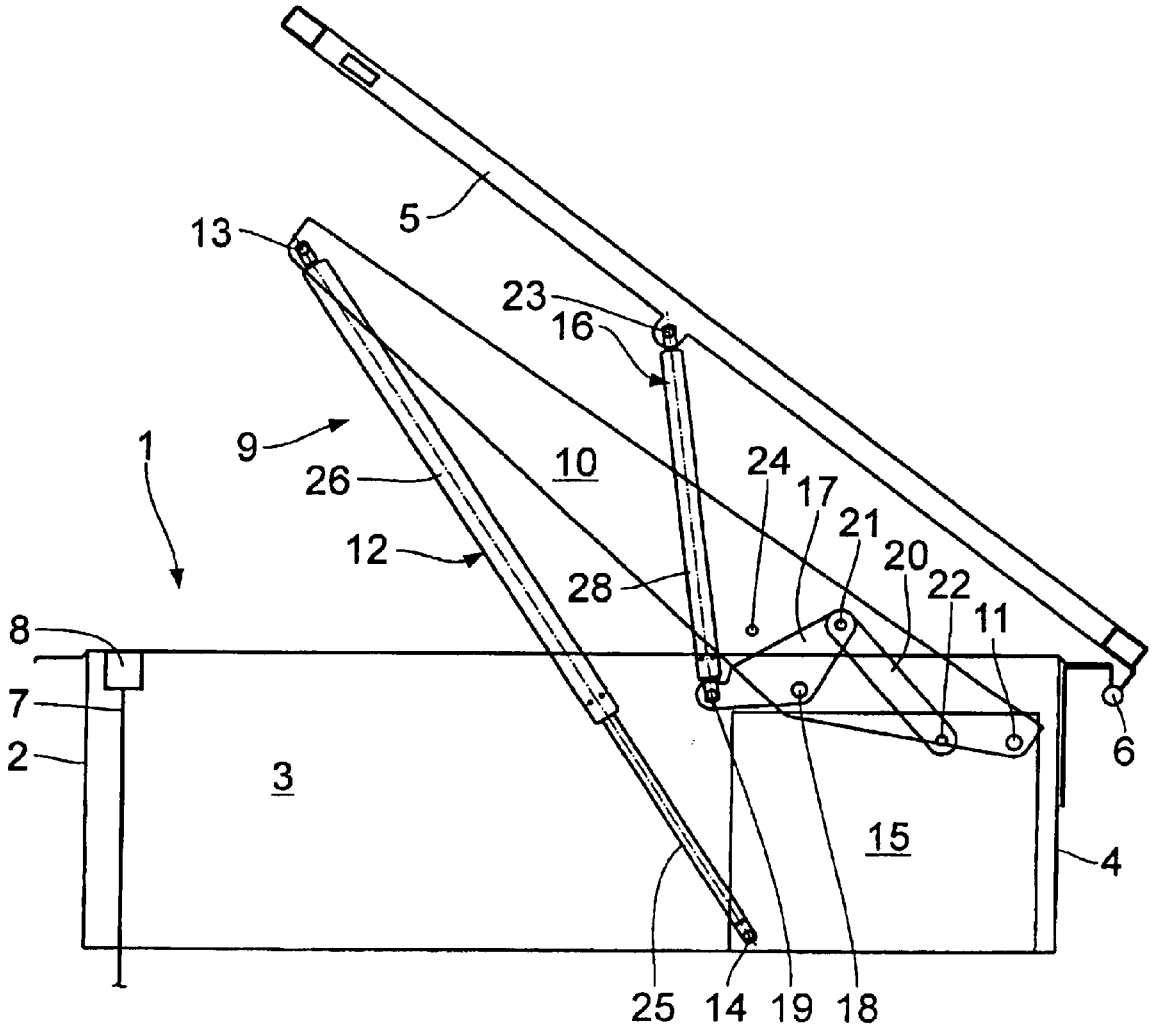

The point of articulation, formed by the pivot joint 19, of the secondary gas spring 16 is moved backwards in relation to the lift arm 10 at the beginning of the flap-5-*opening* motion approximately as far as into the position seen in FIG. 2 i.e., it is pivoted counter-clockwise. Upon extension of the piston rod 25 of the principal gas spring 12, the secondary gas spring 16 is motioned backwards, only serving as a forcing lever during this part of the opening motion. So, only a comparatively smaller flap-5-opening travel is accomplished for the same length of extension of the piston rod 25 from the casing 26 of the principal gas spring 12. This applies to the area of opening where the principal gas spring 12 must muster the greatest opening force. As the opening motion proceeds, the direction of pivoting of the double-armed lever 17 reverses; it pivots clockwise in relation to the lift arm 10, as a result of which the point of articulation 19 of the secondary gas spring 16 to the lever 17 is additionally moved in the direction of opening, although the secondary gas spring 16 still only works as a forcing lever. This is due to the fact that, with the lift arm 10 pivoting upwards, the distance of the joint 18 from the joint 22 grows, as a consequence of which the tie 20 pivots the double-armed lever 17 in such a way that the point of articulation formed by the joint 19 is displaced towards the flap 5. The motion of extension of the principal gas spring 12 terminates when the double-armed lever 17 bears against the stop 24. This also ensures that the tie 20 is not suddenly exposed to pressure forces. On the side of the flap 5, the secondary gas spring 16 and the double-armed lever 17 make an angle of less than 180°. This also helps maintain the described function of transmission.

Then the flap 5 is opened into a position far beyond the top dead center seen in FIG. 5 by extension of the piston rod 27 from the casing 28 of the secondary gas spring 16. Since—contrary to the motion into the position according to FIG. 4—this part of the flap-5-opening motion takes place by the action of gravity, rather than against gravity, it can be sufficient for the secondary gas spring 16 primarily or exclusively to fulfil the function of a gas pressure damper i.e., of a gas spring that has a high damping effect in the direction of extension. These gas springs are commercial. If, however, the flap 5, upon opening from the position of FIG. 4 into the position of FIG. 5, must additionally move, or compress, snow, or if it has to be operated against wind power, then a secondary gas spring 16 of greater extension force can be useful. The damping function can be useful in any case.

Figure 6:
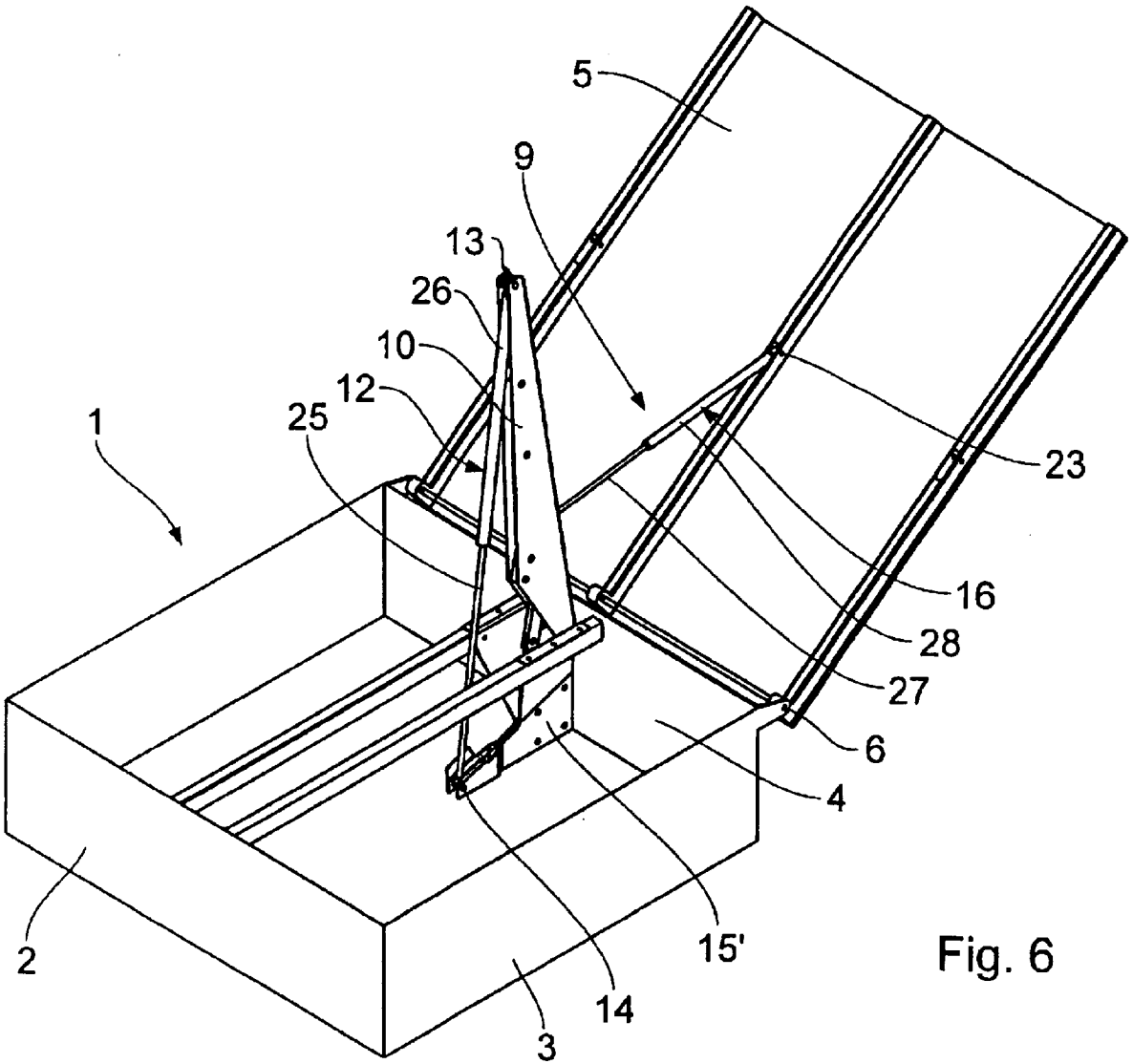
FIGS. 6 to 10 are illustrations of a second embodiment, slightly modified as opposed to the first embodiment, of a flue gas escape flap in varying positions ranging from a closed to an entirely open position.

The embodiment according to FIGS. 6 to 10 slightly differs from the embodiment according to FIGS. 1 to 5. FIG. 6 is a perspective view of the design and fastening of the base plate 15' on the frame 1. It is also a perspective view of the design of the flap 5. The double-armed lever 17' comprises a oblong hole 29 in the shape of a segment of a circle, which is concentric of the pivot joint 18 and has a stop pin 30 guided therein that is tightly mounted on the lift arm 10. The tie 20' includes an oblong hole 31 which extends in the longitudinal direction of the tie 20', with a stop pin 32 guided therein that is tightly joined to the double-armed lever 17', simultaneously constituting the joint 21. The stop 24 of the first embodiment does not exist.

Figure 7:
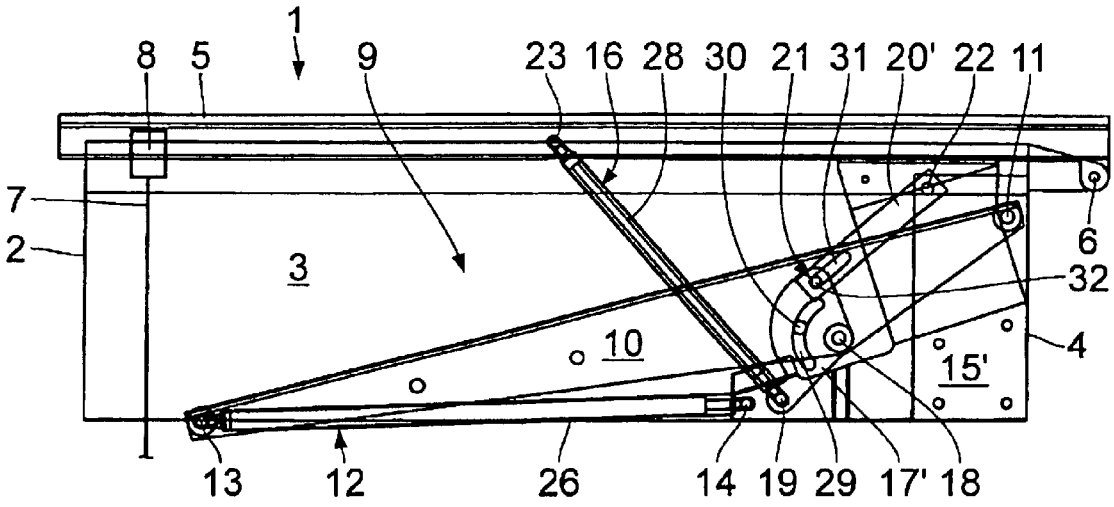
Figure 8:
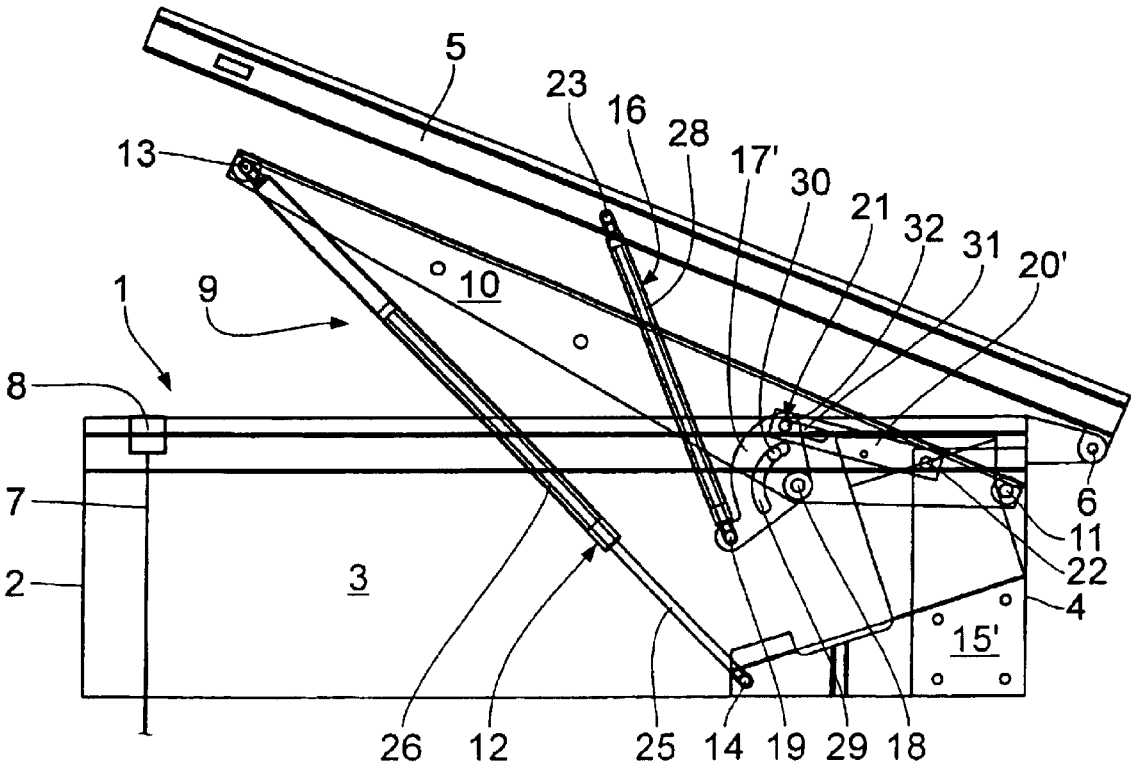
Figure 9:
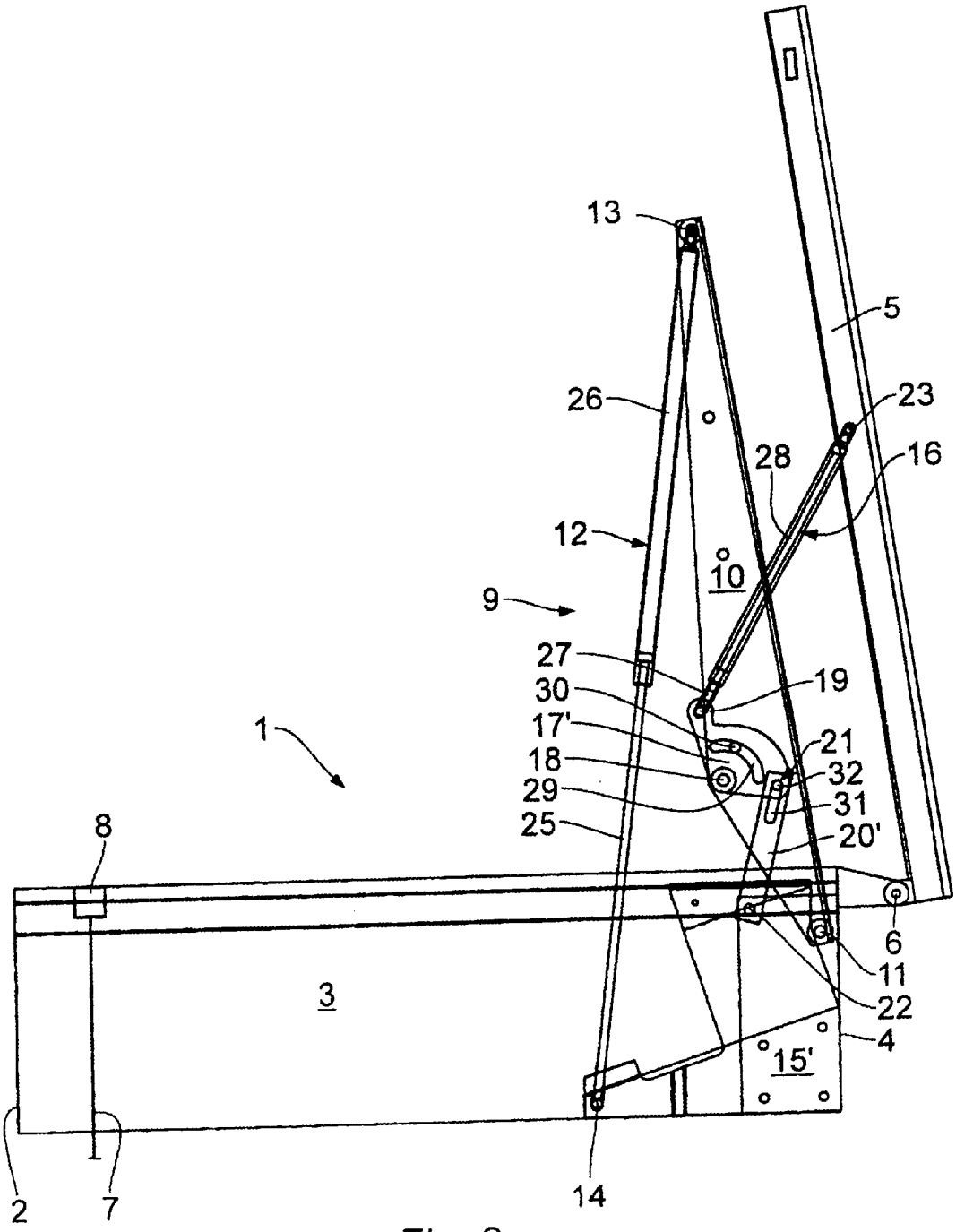
Figure 10:
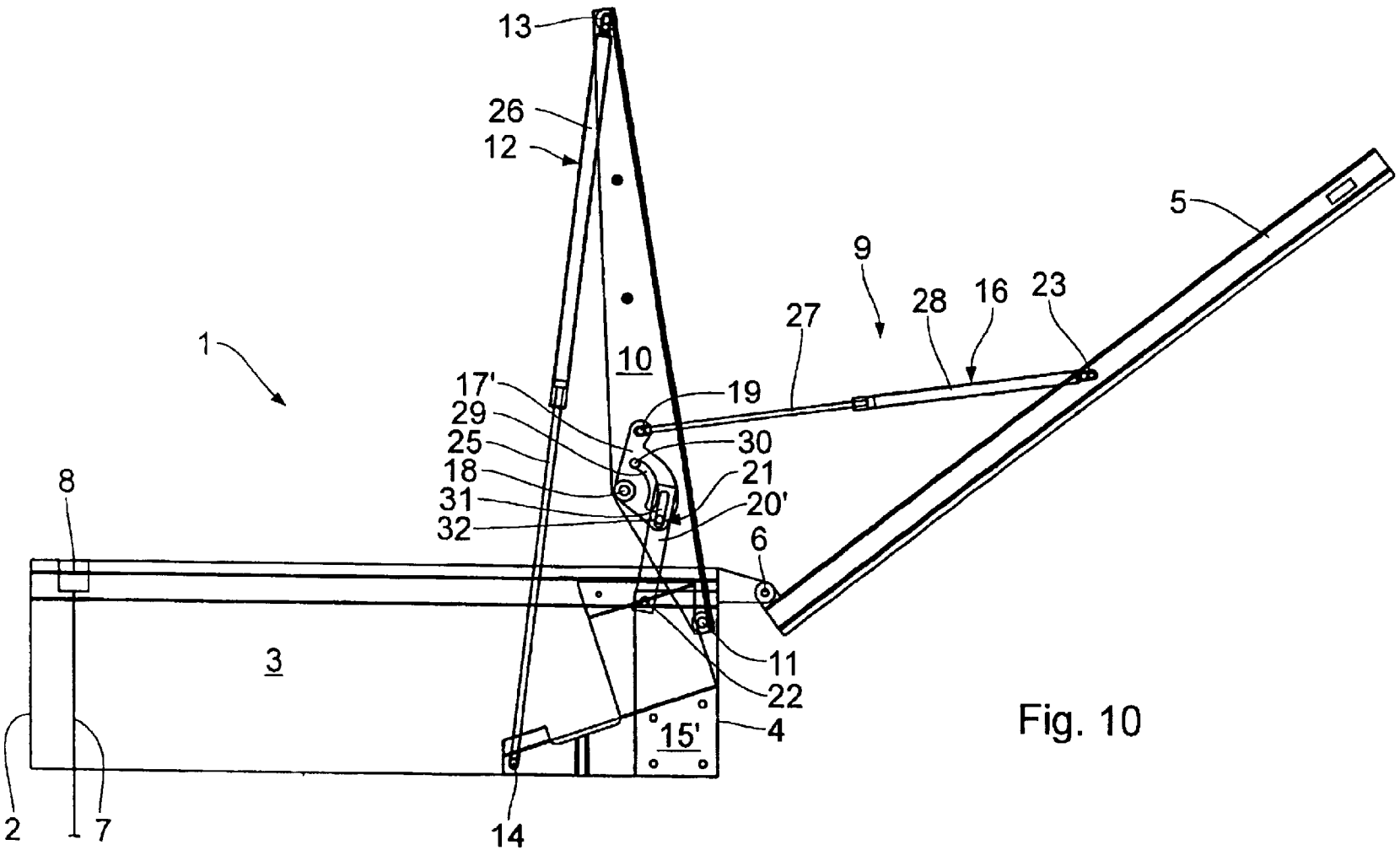

As seen in FIG. 7 which shows the closed position of the flap 5, the stop pin 30 is approximately in the middle of the oblong hole 29 in the shape of a segment of a circle. The stop pin 32 bears against the end of the oblong hole 31 that faces away from the joint 22. When the flap 5 is pivoted upwards in accordance with FIG. 8, the double-armed lever 17'— in the way specified—is pivoted such that the stop pin 30 moves within the oblong hole 29 towards the end in vicinity to the joint 21 without touching it. There is no change in the position of the stop pin 32 relative to the oblong hole 31. When the flap 5 continues to open by the principal gas spring 12 being completely extended, the pivoting motion of the double-armed lever 17' relative to the lift arm 10 reverses in the way specified without the stop pin 30 touching the end, neighboring the pivot joint 19, of the oblong hole 29 in the shape of a segment of a circle—as seen in FIG. 9. The opening motion of the flap 5 is continued by the momentum of the preceding opening motion and by the secondary gas spring 16. When the flap 5 has been pivoted sufficiently beyond its dead center, any further opening motion will be damped by the secondary gas spring 16. Now the lever 17' is being pivoted for the stop pin 30 to bear against the end of the oblong hole 29 in vicinity to the pivot joint 19, as seen in FIG. 10. The stop pin 32 migrates within the oblong hole 31 in a direction towards the end in vicinity to the joint 21 without touching it. This play is provided for the tie 20' not to become subject to compressive strain, but to be fundamentally loaded only by tension. The stop pins 30, 32 will no longer change in position relative to the oblong holes 29 and 31. The described way of pivoting helps attain rather a great angle by which to open the flap 5, it being in particular possible to affect the aperture angle by modification of the oblong hole 29.

Figure 11:
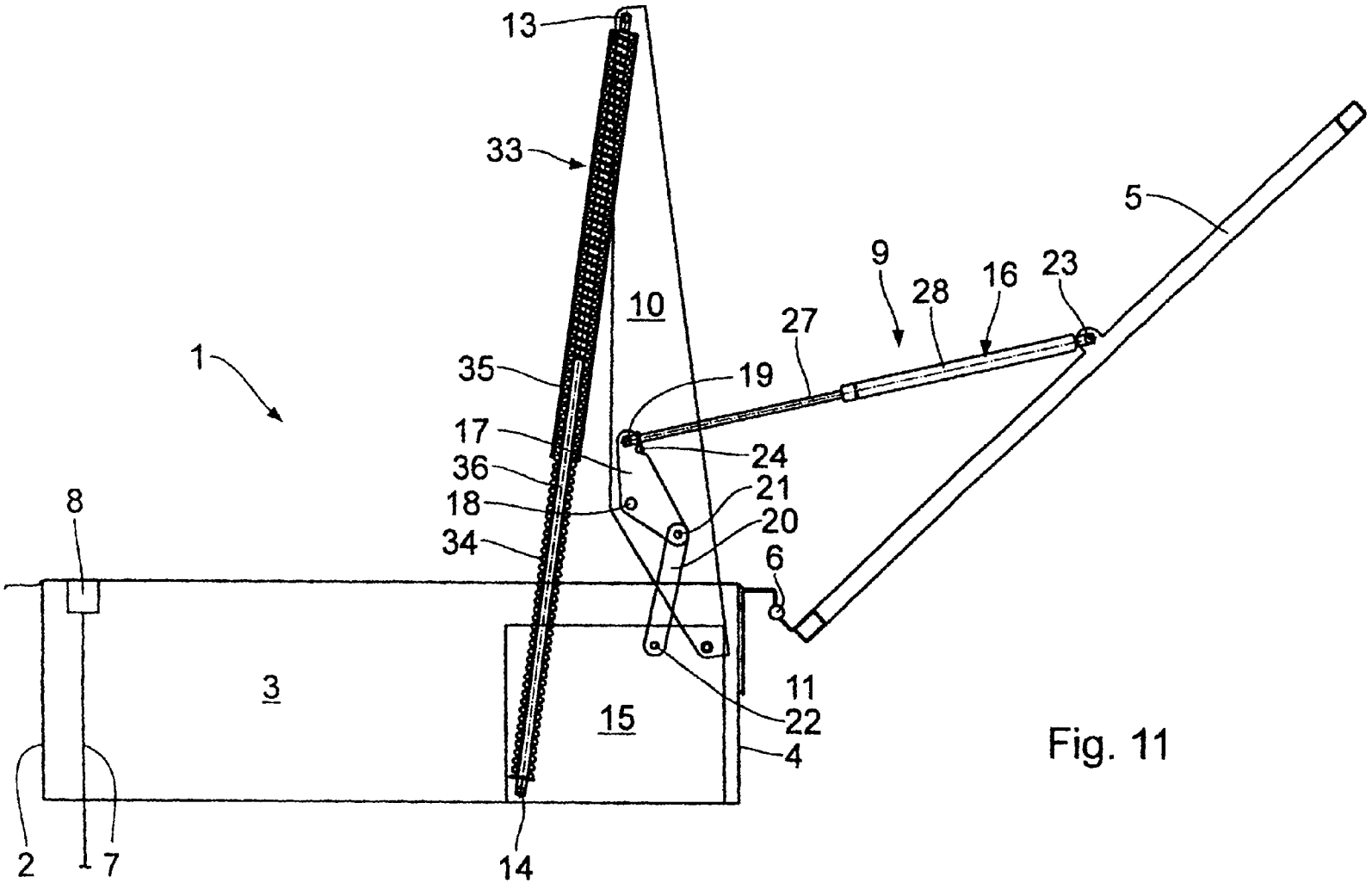
FIG. 11 is an illustration of the first embodiment with a modified energy accumulator.

The principal energy accumulator may also be provided in the form of a compression strut 33 with a pre-loaded helical compression spring 34 disposed in a guide tube 35 that is articulated to the lift arm 10 by the pivot joint 13. On the other hand, it comprises a guide rod 36 which is articulated to the base plate 15 by way of the pivot joint 14. This embodiment will become apparent from FIG. 11, it being possible that the secondary energy accumulator—as mentioned above—is a pure damper or a compression strut of the same kind.

What is claimed is:

1. An opening flap, in particular flue gas escape flap, comprising a frame (1);

a flap (5) that is articulated to the frame (1);

a holding device (8) for keeping the flap (5) in a closed position;

a lift arm (10) which is mounted for pivoting about a first joint (11) that is stationary relative to the frame (1);

a principal energy accumulator (12), a first end of which is articulated to a second joint (14) that is stationary relative to the frame (1), and a second end of which is articulated to the lift arm (10) by a third joint (13) at a distance from the first joint (11); and a secondary energy accumulator (16), a first end of which is articulated to the lift arm (10) between the first and the second joint (11, 13), and a second end of which is articulated to the flap (5);

wherein, articulated to the lift arm (10) by a pivot joint (18) is a double-armed lever (17, 17'), to a first end, turned towards the principal energy accumulator (12), of which the secondary energy accumulator (16) is articulated by its first end, and to a second end, turned towards the flap (5), of which is articulated a first end of a tie (20) which is articulated by a second end relative to the frame (1).

2. A flap according to claim 1, wherein the double-armed lever (17, 17') and the tie (20, 20') are arranged and designed such that, at the beginning of the opening motion of the flap (5), the first end of the secondary energy accumulator (16) is moved counter to a direction of extension of the secondary energy accumulator (16), pivoting the double-armed lever (17, 17'); and wherein the pivoting motion of the double-armed lever (17, 17') reverses as the opening motion of the flap (5) proceeds.

3. A flap according to claim 2, wherein a stop (24, 30) is provided on the lift arm (10) within the pivoting travel of the double-armed lever (17, 17').

4. A flap according to claim 1, wherein the following applies to the extension force ($F_{12}$) of the principal energy accumulator (12) in relation to the extension force ($F_{16}$) of the secondary energy accumulator (16): $F_{12} \geqq F_{16}$.

5. A flap according to claim 1, wherein the following applies to the extension force ($F_{12}$) of the principal energy accumulator (12) in relation to the extension force ($F_{16}$) of the secondary energy accumulator (16): $6\ F_{16} \geqq F_{12} \geqq 2\ F_{16}$.

6. A flap according to claim 1, wherein the following applies to the extension force ($F_{12}$) of the principal energy accumulator (12) in relation to the extension force ($F_{16}$) of the secondary energy accumulator (16): $10\ F_{16} \geqq F_{12} \geqq 2\ F_{16}$.

7. A flap according to claim 1, wherein the secondary energy accumulator (16) is a gas spring (16) that is damped in the direction of extension.

8. A flap according to claim 1, wherein the double-armed lever (17') has an oblong hole (29) in the shape of a segment of a circle, which is concentric of the pivot joint (18), with a stop pin (30) guided therein that is formed on the lift arm (10).

9. A flap according to claim 1, wherein the tie (20') has an oblong hole (31) where a stop pin (32) is guided that is mounted on the double-armed lever (17').

10. A flap according to claim 1, wherein at least one of the principal energy accumulator and the secondary energy accumulator is a gas spring (12, 16).

11. A flap according to claim 1, wherein at least one of the principal energy accumulator and the secondary energy accumulator is a compression strut (33).

12. An opening mechanism for an opening flap, in particular for a flue gas escape flap, the opening flap comprising a frame (1);

a flap (5) that is articulated to the frame (1); and a holding device (8) for keeping the flap (5) in a closed position; and the opening mechanism comprising a lift arm (10) which is mounted for pivoting about a first joint (11) that is stationary relative to the frame (1);

a principal energy accumulator (12), a first end of which is articulated to a second joint (14) that is stationary relative to the frame (1), and a second end of which is articulated to the lift arm (10) by a third joint (13) at a distance from the first joint (11); and a secondary energy accumulator (16), a first end of which is articulated to the lift arm (10) between the first and the second joint (11, 13), and a second end of which is to be articulated to the flap (5);

wherein, articulated to the lift arm (10) by a pivot joint (18) is a double-armed lever (17, 17'), to a first end, turned towards the principal energy accumulator (12), of which the secondary energy accumulator (16) is articulated by its first end, and to a second end, turned towards the flap (5), of which is articulated a first end of a tie (20) which is articulated by a second end relative to the frame (1).

13. An opening mechanism according to claim 12, wherein the double-armed lever (17, 17') and the tie (20, 20') are arranged and designed such that, at the beginning of the opening motion of the flap (5), the first end of the secondary energy accumulator (16) is moved counter to a direction of extension of the secondary energy accumulator (16), pivoting the double-armed lever (17, 17'); and wherein the pivoting motion of the double-armed lever (17, 17') reverses as the opening motion of the flap (5) proceeds.

14. An opening mechanism according to claim 13, wherein a stop (24, 30) is provided on the lift arm (10) within the pivoting travel of the double-armed lever (17, 17').

15. An opening mechanism according to claim 12, wherein the following applies to the extension force ($F_{12}$) of the principal energy accumulator (12) in relation to the extension force ($F_{16}$) of the secondary energy accumulator (16): $F_{12} \geqq F_{16}$.

16. An opening mechanism according to claim 12, wherein the following applies to the extension force ($F_{12}$) of the principal energy accumulator (12) in relation to the extension force ($F_{16}$) of the secondary energy accumulator (16): $6\ F_{16} \geqq F_{12} \geqq 2\ F_{16}$.

17. An opening mechanism according to claim 12, wherein the following applies to the extension force ($F_{12}$) of the principal energy accumulator (12) in relation to the extension force ($F_{16}$) of the secondary energy accumulator (16): $10\ F_{16} \geqq F_{12} \geqq 2\ F_{16}$.

18. An opening mechanism according to claim 12, wherein the secondary energy accumulator (16) is a gas spring (16) that is damped in the direction of extension.

19. An opening mechanism according to claim 12, wherein the double-armed lever (17') has an oblong hole (29) in the shape of a segment of a circle, which is concentric of the pivot joint (18), with a stop pin (30) guided therein that is formed on the lift arm (10).

20. An opening mechanism according to claim 12, wherein the tie (20') has an oblong hole (31) where a stop pin (32) is guided that is mounted on the double-armed lever (17').

21. An opening mechanism according to claim 12, wherein at least one of the principal energy accumulator and the secondary energy accumulator is a gas spring (12, 16).

22. An opening mechanism according to claim 12, wherein at least one of the principal energy accumulator and the secondary energy accumulator is a compression strut (33).

* * * * *